United States Patent [19]

Musselmann et al.

[11] 4,165,841

[45] Aug. 28, 1979

[54] APPARATUS FOR SEPARATING CONTAMINANTS FROM FIBROUS SUSPENSIONS

[75] Inventors: Walter Musselmann; Reimund Rienecker, both of Heidenheim, Fed. Rep. of Germany

[73] Assignee: J. M. Voith GmbH, Heidenheim, Fed. Rep. of Germany

[21] Appl. No.: 903,644

[22] Filed: May 4, 1978

Related U.S. Application Data

[63] Continuation of Ser. No. 860,025, Dec. 12, 1977, abandoned, which is a continuation of Ser. No. 730,614, Oct. 7, 1976, abandoned.

[30] Foreign Application Priority Data

Oct. 30, 1975 [DE] Fed. Rep. of Germany ..... 2548578

[51] Int. Cl.[2] ..... B02C 23/36

[52] U.S. Cl. ..... 241/46.02; 209/211; 241/46.11

[58] Field of Search ..... 241/21, 24, 46.02, 46.11, 241/46.17, 46 R, 74, 79.2, 80, 81; 209/211, 273, 300

[56] References Cited

U.S. PATENT DOCUMENTS

| | | | |
|---|---|---|---|
| 3,912,622 | 10/1975 | Bolton et al. | 233/46 X |
| 3,945,576 | 3/1976 | Kahmann | 241/46.11 X |

*Primary Examiner*—Richard B. Lazarus

*Attorney, Agent, or Firm*—Edwin E. Greigg

[57] ABSTRACT

An apparatus for purifying a fibrous suspension which contains contaminants of varying size and mass has a housing and a rotor for imparting a vortex motion to the fluid contained in the housing. Lighter contaminants are collected in the core of the vortex and travel generally on axis to an opening in the end of the housing. Heavier contaminants acquire radial velocity due to centrifugal force and migrate to the wall of the housing when the stream is deviated by nearly 180°. The liquid then traverses a surrounding screen which retains further contaminants. Provision is made for comminuting specks and the like.

8 Claims, 2 Drawing Figures

Detail X

APPARATUS FOR SEPARATING CONTAMINANTS FROM FIBROUS SUSPENSIONS

This is a continuation of application Ser. No. 860,025, filed Dec. 12, 1977 now abandoned and which is a continuation of Ser. No. 730,614 filed Oct. 7, 1976 now abandoned.

BACKGROUND OF THE INVENTION

The invention relates to a method and an apparatus for performing the method of separating contaminants of various types present in fibrous suspensions. The invention particularly relates to fibrous suspensions common in the production of paper and of cellulose or the like. In the separation apparatus, the fluid is admitted into a housing in which a rotor generates a potential vortex in such a way that lightweight contaminants accumulate in a wall region generally opposite the rotor while the relatively heavy contaminants migrate radially outward and are eliminated from the housing while the cleaned suspension traverses a sieve and is also removed from the housing.

A method and an apparatus for performing this method has been described in U.S. Pat. No. 3,844,488. The main area of use of this method and apparatus is in the preparation of recycled paper. A rotor creates a potential vortex which separates the contaminants of relatively low and high weight. The lightweight contaminants travel in the core of the vortex and are removed through an opening located opposite the rotor on its own axis. The heavier contaminants are removed at the circumference of the container. One major disadvantage of the known apparatus described above is that the sieve surface which is effective for the flow of fluid is small and thus presents upper limits for the throughput. Furthermore, the wear and tear on the rotor, the sieve or screen, as well as the container itself, is high because the fluid flow within the housing as well as the removal of heavy contaminants do not take place in an optimum manner. The continuous rollover motion of the heavy contaminants in particular causes those contaminants to contact the rotor and the screen often with the result of causing substantial wear and tear in these parts.

OBJECT AND SUMMARY OF THE INVENTION

It is a principal object of the present invention to provide a method and an apparatus for carrying out that method of separating the contaminants in fluid suspension of the above-described kind, while attaining a high degree of efficiency, avoiding the above-mentioned disadvantages and thus preventing substantially the susceptibility of the apparatus to wear and tear. This and other objects are attained according to the invention by providing an apparatus with a housing which has an inlet chamber to which the fibrous suspension is admitted and from which it passes through openings in the rotor generally along the rotor axis to the interior main chamber of a drum which is connected to the rotor and rotates with it. The lateral wall of this drum is closed, so that the fluid flow is generally axial, and fluid which emerges from the drum is substantially deviated, by approximately 180°, and passes thereafter through a fixed screening basket which retains contaminants and passes the cleaned suspension. Any fluid which does not pass through the screen basket, furthermore, can be returned to the inlet to repeat the cleaning procedure.

The above method and apparatus is such that the sensitive elements of the machine, for example the screen basket, are much better protected against wear and tear and the fluid flow through this screen basket is relatively gentle. Furthermore, the preliminary cleaning which takes place in the drum and the disposition of the screen basket permit high throughput and high effectiveness.

The separation of the contaminants of light and heavy weight occurs outside of the effective region of the screen basket. The light contaminants are carried by the potential vortex flow in essentially axial motion and migrate to the end of the housing opposite the rotor, while the contaminants of high specific weight accumulate at the interior wall of the rotating drum due to the centrifugal force, i.e., the radial pressure gradient, from which they are easily transported to the wall of the housing and are removed through an appropriate opening. Thus, the screen basket itself rarely encounters contaminants directly and thus remains free from contamination.

The special flow characteristics and the pre-cleaning which takes place in the drum, as well as the protection of the screen basket, also act as a protection for the remaining elements of the housing. The rotating drum itself is not subject to any substantial wear and tear because the suspension rotates with the drum and thus there is only a small amount of relative rotational motion. Furthermore, in the region of the potential vortex, the suspension is free from the heavy particles which are the main cause of the wear and tear.

One of the causes for the higher throughput of which the present apparatus is capable is the substantially larger screen basket but also the considerable amount of prior separation of contaminants which takes place on the basis of the radial pressure gradient in the region of the vortex flow. A major improvement over the apparatus according to the state-of-the-art is that there is available a substantially greater amount of screen surface and all of the portions of the screen receive substantially the same type of flow. These factors reduce the required overall space for the apparatus.

The method of this invention is carried out, in particular, by an apparatus which provides a housing, an inlet opening for the fibrous suspension, a rotor disposed within the housing and a screen basket surrounding the rotor. Behind the screen the housing has an opening for removing the cleaned fibrous suspension and a wall region generally opposite the rotor in its axial extension contains a drain for the contaminants of light specific weight, while the circumference wall of the housing has an opening for heavier contaminants. The apparatus further provides a chamber located upstream of the rotor for receiving unpurified fluid and for providing openings in the rotor for passage of fluid in the generally axial direction into a drum whose circumferential walls are closed and which co-rotates with the rotor. The screen is a substantially cylindrical screen, surrounding the drum and disposed coaxially therewith, whose length is approximately equal to that of the drum which it surrounds. The drum is preferably provided with external elements which affect the fluid flow and which aid in returning the suspension to the inlet chamber.

The apparatus according to the invention is an advantageous construction for carrying out the method of the invention because it provides a high degree of separation of the relatively light and heavy contaminants without removing useful fibers from the suspension to any substantial degree. The wear and tear and the load on the screen basket is much lower than in the apparatus according to the state-of-the-art. The flow control elements located on the outside of the drum tend to provide a rollover effect within the housing which is also aided by the pressure gradient between the screen basket and the inlet chamber.

In a further feature of the invention, the rotor is provided with a centrifugal disc which is effective between the inlet chamber and the rest of the housing for flinging contaminants back into the inlet chamber or to an appropriate outlet. This characteristic provides a better stirring of the suspension and, furthermore, prevents direct transmission of the rotating suspension into the screening chamber without prior motion through the rotor. Advantageously, the centrifugal disc may be provided with rib-like structures which also increase the stirring effect, particularly if the suspension contains specks which as known in the art, are incompletely dissolved pieces of fiber or even bundles of fiber. In a very useful and important characteristic of the present invention, the centrifugal disc may have de-specking mechanisms which cooperate with similar devices mounted on the housing for removing or comminuting the specks contained in the suspension. In yet another feature of the invention, the region of the de-specking mechanism may be provided with an outlet for material containing specks. Any material removed through this outlet can be separately processed, for example by returning it into an upstream dissolver device.

It is advantageous to provide an annular chamber in the vicinity of the de-specker gap for locating the specked material outlet. In order to aid the return of the suspension into the inlet chamber, the outer circumference of the drum may be provided with elements for flow control, for example welded-on steps, spiral fences or the like for aiding in the transport of the fluid in a particular manner. It is advantageous for the overall effect if the outlet for removing the heavier contaminants is located in the region of that end of the drum which is remote from the rotor. Thus, the heavier contaminants which are responsible for most of the wear and tear are removed on the shortest path.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
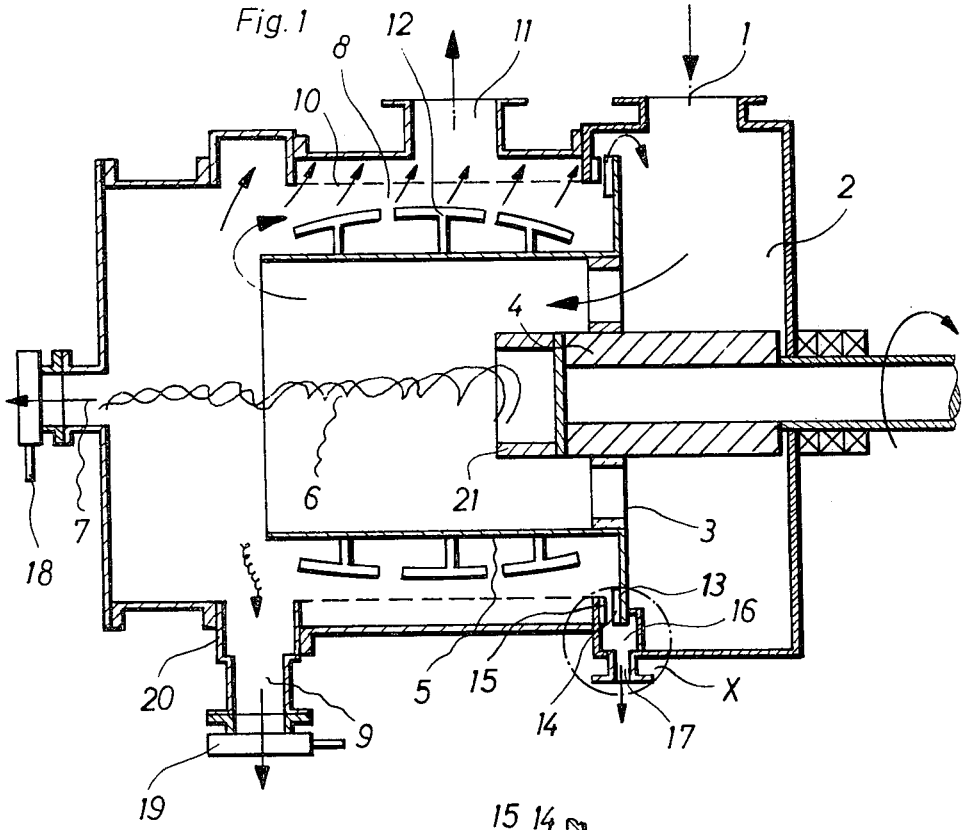
FIG. 1 is a longitudinal section through an apparatus according to the invention.

Turning now to FIG. 1, there is shown a longitudinal cross section of an apparatus according to the invention having a housing with an inlet 1 for receiving a fibrous suspension to be cleaned. The suspension arrives under pressure in an inlet chamber 2 and flows through openings 3 in a rotor 4 into the interior of the housing. The rotor 4 is coupled to a closed drum 5 which extends coaxially with the rotor axis and shares its motion. The rotor 4 rotates the suspension within the interior of the drum 5 so that there is formed a vortex whose core 6 tends to be a locus for the concentration of relatively lightweight contaminants. Such contaminants are removed through a drain 7. The core of the vortex is further stabilized if the rotor 4 has a centralizing ring 21, essentially a cylindrical extension of the rotor shaft.

The pre-cleaned material arriving in the vicinity of the end of the rotor drum 5 is deviated by the form of the housing and flows along the outer surface of the drum 5 into a screening zone 8. Any contaminants of heavy specific weight are previously transported to the outside wall of the housing by the effects of the centrifugal force which they experience when they reach the end of the drum 5 as well as by the deviation of the fluid flow. Such contaminants are removed to an outlet opening 9 for the heavy contaminants.

The cleaned suspension which has traversed the screen basket 10 is removed from the housing through the drain 11.

Any material retained by the screening basket 10 is moved along the screen surface by wings 12 mounted on the exterior of the rotor drum 5 which may be disposed obliquely or spirally in order to aid the transport of the material. These contaminants are removed out of the screen zone 8 onto a centrifugal disc 13 which returns them to the inlet chamber 2. If the suspension to be treated contains a large amount of specks, the centrifugal disc 13 may be provided with a de-specking mechanism or deflaker 14 which cooperates with an appropriate de-specking mechanism or deflaker 15 mounted on the housing. Such mechanisms may be known knives, perforated discs, or the like. The suspension is then returned to the inlet chamber 2. If it is desired to smooth out the suspension even further, then any speck-containing material which is not sufficiently smoothed out may be transported into an annular chamber 16 in the vicinity of the de-specking device from which it can be taken through an outlet 17 and processed separately.

Figure 2:
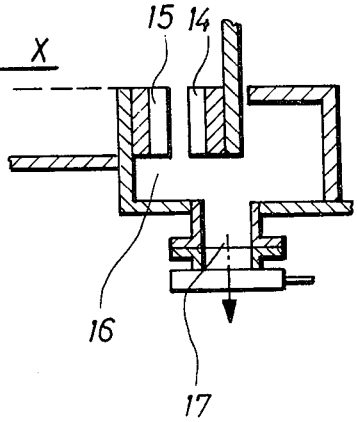
FIG. 2 is an enlarged view of the detail X of FIG. 1.

The de-specking or deflaker mechanism itself is shown in enlarged manner in FIG. 2.

In order to avoid the loss of useful fibers from the suspension, the outlet 7 for the lightweight contaminants and the outlet 9 for the heavier contaminants have appropriate closure elements 18 and 19, respectively, which are opened only from time to time and which serve to control the flow therethrough. If necessary however, the flow can be controlled continuously through the pressure levels prevailing within the housing.

The outlet 9 for the contaminants of high specific weight is located in an annular chamber 20 whose diameter is made larger than that of the screen basket. This insures a separation of the heavier contaminants prior to their having made any contact with the screen basket.

The foregoing relates to a preferred embodiment of the invention, it being understood that other embodiments and variants thereof are possible within the spirit and scope of the invention, the latter being defined by the appended claims.

What is claimed is:

1. Apparatus for purifying a fibrous liquid suspension, comprising:

a housing having an inlet at one end for a fibrous suspension to be purified;

a hollow cylindrical rotor mounted to and extending into said housing, said rotor defining a drum being open at one end and having openings at the opposite end communicating with said inlet;

a light contaminant outlet in said housing aligned with the axis of said rotor and facing the open end of said rotor;

a stationary cylindrical screen in said housing coaxially surrounding said rotor;

a drain in said housing communicating with the outer surface of said screen; and a heavy contaminant outlet in said housing adjacent to the open end of said drum for removing the heaviest contaminants of said suspension which are thrown radially outwardly from the open end of said drum before the remainder of said suspension flows to said screen.

2. An apparatus as defined in claim 1, further comprising first comminuting means and wherein said housing is provided with cooperating second comminuting means for comminuting solid matter in said liquid suspension.

3. An apparatus as defined by claim 2, wherein said first and second comminuting means form a gap and wherein there is provided in the vicinity of said gap a third outlet for liquid suspension containing specks.

4. An apparatus as defined by claim 3, wherein said housing includes an annular chamber at the level of said gap and wherein said third outlet is located in said annular chamber.

5. An apparatus as defined in claim 1, further comprising:

protrusions mounted to and extending beyond the circumference of the drum and distributed about the external surface thereof.

6. An apparatus as defined by claim 5, wherein said protrusions are disposed in a spiral pattern.

7. An apparatus as defined by claim 5, wherein said protrusions are distributed in random pattern.

8. An apparatus as defined by claim 5, wherein said protrusions are welded-on bars.

* * * * *